US005357938A

United States Patent [19]

Bedford et al.

[11] Patent Number: 5,357,938

[45] Date of Patent: Oct. 25, 1994

[54] EXHAUST EMISSION CONTROL IN GASEOUS FUELLED ENGINES

[75] Inventors: Timothy J. Bedford, Castle Donington; John W. Kirkland, Ashbourne, both of United Kingdom

[73] Assignee: Green Power International Limited, Shropshire, United Kingdom

[21] Appl. No.: 160,362

[22] PCT Filed: Apr. 22, 1991

[86] PCT No.: PCT/GB91/00634

§ 371 Date: Dec. 16, 1992

§ 102(e) Date: Dec. 16, 1992

[87] PCT Pub. No.: WO91/16531

PCT Pub. Date: Oct. 31, 1991

Related U.S. Application Data

[63] Continuation of Ser. No. 937,827, Dec. 16, 1992, abandoned.

[30] Foreign Application Priority Data

Apr. 22, 1990 [GB] United Kingdom ..... 9008915

[51] Int. Cl.[5] ..... F02D 11/08; F02D 41/14

[52] U.S. Cl. ..... 123/685; 123/527

[58] Field of Search ..... 123/527, 672, 685, 701, 123/702

[56] References Cited

U.S. PATENT DOCUMENTS

| | | | |
|---|---|---|---|
| 4,034,727 | 7/1977 | Aono et al. | 123/701 |
| 4,188,919 | 2/1980 | Bruce | 123/527 X |
| 4,263,883 | 4/1981 | Treible et al. | 123/527 X |
| 4,364,364 | 12/1982 | Subramaniam | 123/703 X |
| 4,369,751 | 1/1983 | Batchelor et al. | 123/672 |
| 4,413,607 | 11/1983 | Batchelor et al. | 123/694 X |
| 4,512,304 | 4/1985 | Snyder | 123/701 X |
| 4,809,307 | 5/1978 | Nakamura | 123/337 |

OTHER PUBLICATIONS

"Patent Abstracts of Japan", vol. 11, No. 352 (M-643), Nov. 18, 1987 (abstract of JP-A-62-131958).

"Patent Abstracts of Japan", vol. 3, No. 144 (M-082), Nov. 28, 1979 (abstract of JP-A-54-121323).

*Primary Examiner*—Tony M. Argenbright

*Attorney, Agent, or Firm*—Walter J. Blenko, Jr.; George K. Stacey

[57] ABSTRACT

A fuel supply control for an internal combustion engine designed to run on gaseous fuel (LPG or CNG) utilizes a feedback loop from a lambda sensor in the exhaust gases to a moving coil (82) mounted on a diaphragm (34) of a diaphragm-actuated valve (24) controlling the flow of gaseous fuel to the engine. The coil (82) is similar to the speaker coil of an audio speaker, and moves concentrically of a fixed permanent ring magnet (86) to impart a variable bias on the diaphragm(34) in accordance with the oxygen content of the exhaust gas stream as sensed by the lambda sensor, to control the fuel or air-and-fuel supply to the engine in accordance with desired engine operation parameters. The control has a sufficiently rapid and positive response that it can maintain the free oxygen content in the exhaust gases at substantially 2% for continuous operation of a catalytic exhaust purifier at or nearly at optimum efficiency.

13 Claims, 4 Drawing Sheets

EXHAUST EMISSION CONTROL IN GASEOUS FUELLED ENGINES

This is a continuation of Ser. No. 07/937,827 filed Dec. 16, 1992, now abandoned.

DESCRIPTION

The invention relates to the control of the fuel supply to internal combustion engines fuelled by gaseous fuels such as liquefied petroleum gas (LPG) or compressed natural gas (CNG) or methane or hydrogen. Liquefied petroleum gas, (LPG) is a mixture of butane and propane and is a well accepted high octane, lead free fuel for internal combustion engines. Several million engines worldwide are powered by a variety of gaseous fuels for use in cars, vans, and fork lift trucks.

The equipment used to supply the fuel/air mixture to such engines is substantially the same for all engines. Compressed or liquefied gas from the fuel storage tank is fed to a device known as a pressure regulator or a vaporizer. This device reduces the pressure of the gaseous fuel in one or more initial stages from tank pressure to, generally, slightly less than atmospheric. In all cases, this results in a severe temperature drop. In the case of LPG, the fuel is stored in the tank in its liquid phase and the pressure reduction in the vaporizer causes it to boil to its gaseous phase. The latent heat of evaporation is supplied by heat from the cooling system of the engine via a heat exchanger integral with the vaporizer. In the case of compressed gaseous fuels, a similar cooling of the compressed gas on expansion is countered by an entirely analogous heat exchanger integral with the pressure regulator. The gaseous fuel, still at fuel tank pressure, is further reduced in pressure using a final stage pressure reducing valve. This final stage valve includes a diaphragm-responsive valve element the diaphragm of which is responsive to atmospheric pressure. In this way it can be ensured that the fuel exit pressure is always slightly less than atmospheric.

Gas from the pressure regulator or vaporiser is then fed to a device which mixes it with the charge air to the engine. There are two devices available for mixing the gas with the charge air. One, widely used on cars, is a venturi device placed either in the air filter or in a flexible pipe connecting the air filter to the carburettor. Alternatively, the venturi device can be attached to the top of the carburettor on the intake side. In each case, engine charge air passing through the venturi creates a depression which is a function of the air flow. The venturi is so constructed that there is an annular passage round it which on the one side is connected to the throat of the venturi via a multitude of small holes and on the other side is connected to the gas supply from the pressure regulator or vaporiser using a flexible rubber or braided metallic pipe. The amount of gaseous fuel induced into the engine is a function of the depression and thus of the charge air flow rate. By careful design and subsequent testing, a gas fuel/air ratio which approximates to stoichiometric is achieved. This method is widely used where a gas powered engine is designed to revert to being powered by petrol when needed.

The other device, widely used for dedicated systems in which the engine is fuelled only by gas and cannot revert to petrol operation, is a gas carburettor. Conventional gas carburettors incorporate diaphragm valve elements the diaphragms of which are responsive to atmospheric pressure.

In both cases, it will be appreciated that the gas flow to the mixing device, and thus the actual gas/air ratio to the engine, is a function of the supply gas pressure from the regulator. The reason for maintaining the supply gas pressure slightly less than atmospheric is that in the event of the connecting pipe falling off, there is not a full bore gas leak into the engine compartment.

Operating desiderata for internal combustion engines include the control of exhaust emissions and the ability to operate vehicles with low fuel consumption. To achieve compliance with current and future exhaust emission legislation, engine manufacturers have been forced to use exhaust gas catalytic purifiers. These contain rare earth components which cause undesirable components of the exhaust gas such as carbon monoxide, unburnt hydrocarbons and oxides of nitrogen to be oxidised to more acceptable gases. The efficient operation of the exhaust catalyst is dependent on a residual oxygen content in the exhaust of about 2%. It is critically important that this level of residual oxygen is maintained in the exhaust gas to ensure proper and continuing functioning of the catalytic exhaust gas purifier.

A device known as a "lambda" sensor has been developed and is widely used on all North American and most European cars. The lambda sensor is fitted in the exhaust pipe and, when hot, gives a voltage signal which changes abruptly when the residual oxygen in the exhaust varies either side of 2%. This signal is fed to a computer which deduces whether the oxygen content is either less or greater than 2%. It then commands the fuel system either to increase or to decrease the amount of fuel supplied and so the air fuel ratio and finally the residual oxygen. This has proved relatively easy to achieve when the engine is fitted with an electronically controlled petrol injection system. It is far more difficult to achieve with a carburettor. Attempts to make a gaseous fuel system operate 'closed loop' have so far been clumsy, bulky, slow in responding and very expensive. They are generally based on a stepper motor controlled spool valve inserted between the vaporiser and the gas mixing device.

It is an object of this invention to provide a fuel supply control for gaseous fuel systems for internal combustion engines which will enable them to operate closed loop in an efficient manner and with a rapid response time in response to a control signal from a lambda sensor. This will in turn enable an exhaust gas catalytic purifier to be used efficiently with gas fuelling. It is a further object of the invention to provide such a control in which there is the minimum of modification to the existing standard components and that these modifications are cheaply and easily incorporated. The fast response time results in high overall system performance.

The invention provides a fuel supply control for a gaseous fuelled internal combustion engine in which the flow of gaseous fuel is controlled by a diaphragm-actuated valve response to atmospheric pressure, and wherein the diaphragm of the diaphragm-actuated valve carries a moving coil element secured thereto and concentric with a fixed permanent ring magnet, and a lambda sensor in the exhaust gas stream from the engine supplies an electrical feedback signal to the coil to impart a variable bias on the diaphragm in accordance with the oxygen content of the exhaust gas stream as sensed by the lambda sensor, to control the fuel or air-and-fuel supply to the engine in accordance with desired engine operating parameters.

In the case of an LPG fuelled engine, the diaphragm-actuated valve may be the second stage of a two-stage pressure reducing valve assembly on the LPG vaporizer. In the case of a compressed gas fuelled engine, the diaphragm-actuated valve may be the final stage of a multi-stage (for example three-stage) pressure modulator. In either case a signal from the lambda sensor indicating too little oxygen in the exhaust gas stream (<2%) should bias the valve closed and reduce the gaseous fuel flow to the engine, and a signal indicating too much oxygen in the exhaust gas stream (>2%) should bias the valve open and increase the gaseous fuel flow to the engine. In that way the feedback loop controls the fuel/air ratio to the engine to maintain an oxygen content in the exhaust gas stream of about 2%, which ensures optimum efficiency of a catalytic exhaust gas purifier fitted in the exhaust stream downstream of the lambda sensor.

Alternatively (in the case of engines fuelled by either compressed or liquefied gas) if the gas is mixed with the charge air in a gas carburettor rather than a venturi, then the diaphragm-actuated valve may be a valve element of the gas carburettor. In that case a signal from the lambda sensor indicating too little oxygen in the exhaust gas stream (<2%) should bias the valve open to reduce the flow of gaseous fuel and air to the engine; and a signal indicating too much oxygen (<2%) should bias the valve closed.

The coil may easily be fitted to conventional diaphragm-actuated valves with little or no modification of the associated valve elements in the pressure regulator or vaporizer, or in the gas carburettor. The coil and permanent magnet represent a combination very similar to those found in conventional audio loudspeakers. It is convenient to use audio components so as to benefit from the cost advantages of mass-production.

The diaphragm is free to move without restraint in its normal operating mode until a current is applied to the coil. The reaction between the energized coil and the magnet is bidirectional, depending on the direction of the current supplied, and the force is a function of the magnitude of the current. In the event of failure of the lambda sensor, however, or any other failure in the electrical circuit, the fuel supply control system carries on in normal open loop operation as though the control coil had not been fitted.

Preferably the moving coil is secured to a central plate portion of the associated diaphragm by adhesive optionally in association with two screws which are electrically insulated from each other and which act as electric terminals for the interface between the fixed, insulating wire of the coil windings and flexible fly leads which connect the coil to external wires carrying the feedback signal.

The feedback signal from the lambda sensor to the coil is preferably processed by an engine management computer. The computer is preferably a self-learning computer in the sense that it receives inputs representing engine condition (engine speed and inlet manifold or induction pressure) and maps those in a memory unit against its output feedback signal. For stable engine conditions the feedback signal will be constant. Preferably the map in the memory unit is built up from such stable conditions, as defined by the engine condition having been constant within defined limits for a predefined period. Then for rapidly changing engine conditions the output feedback signal can be taken from the memory unit, using that map as a look-up table, rather than waiting for the lambda sensor output to stabilize. That provides a more rapid response, and one that can sense and allow for engine idle and over-run conditions.

DRAWINGS

Figure 1:
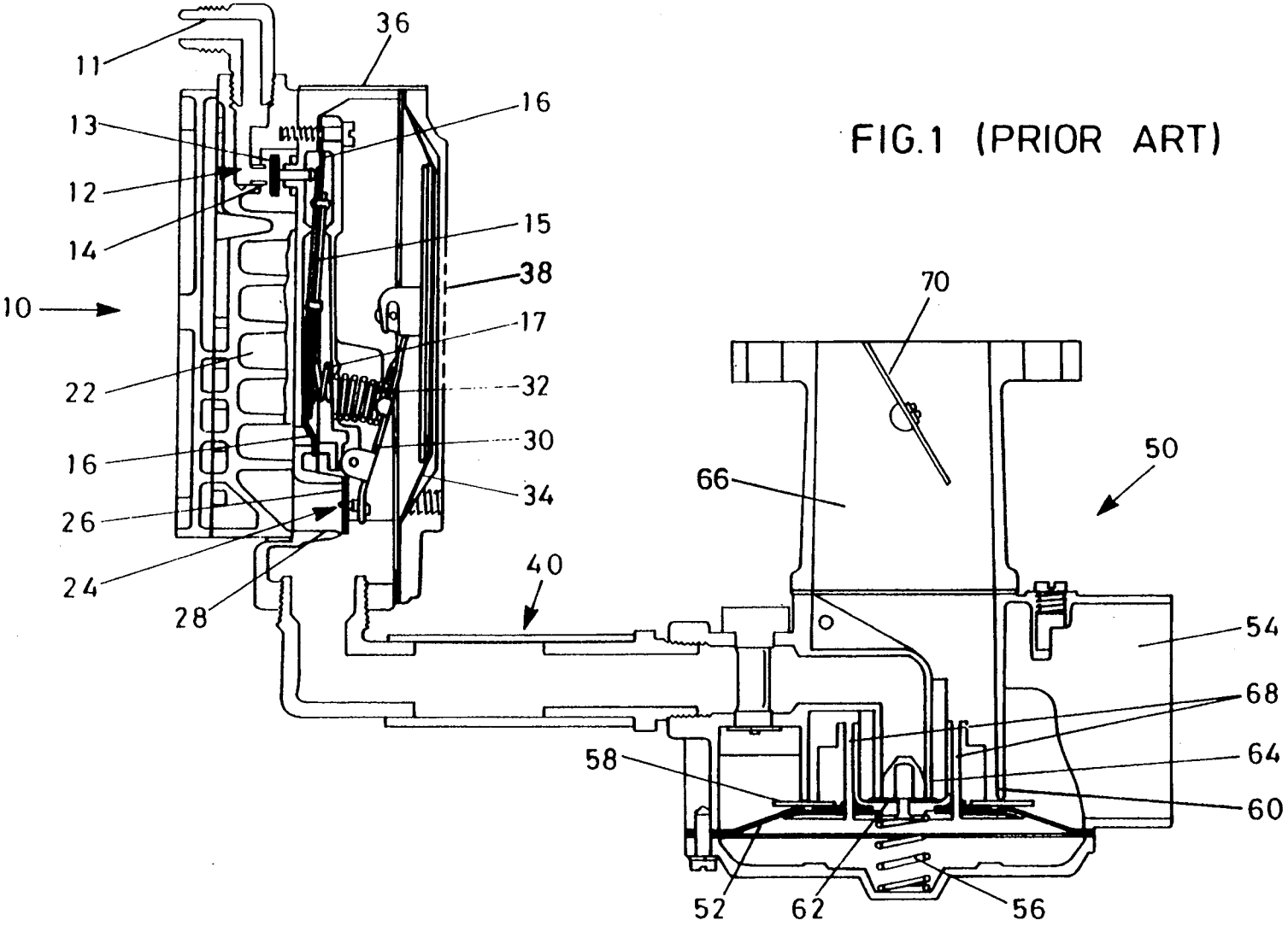
FIG.1 (PRIOR ART)
FIG. 1 is a section through a vaporizer and gas carburettor of a conventional LPG fuel supply for an internal combustion engine.

Referring first to FIG. 1, a vaporizer 10 and a gas carburettor 50 are arranged in series and linked by a gaseous fuel supply line 40. Liquefied petroleum gas is supplied to the vaporizer 10 from a tank (not shown) through an inlet 11. The vaporizer 10 comprises an inlet valve 12 which comprises a disc-shaped valve member 13 biased onto a valve seat 14 by a combination of differential gas pressure and a force applied by a pivoted lever 15 which is attached to a first stage, high pressure, diaphragm 16. The forces acting on the lever 15 at its end remote from the inlet valve 12 are the force applied to the diaphragm 16 by the pressure differential thereacross, and the opposing force of a spring 17. The inlet valve 12 provides a non-return valve for the fuel tank and ensures that the flow of liquefied fuel into the vaporizer 10 is permitted only when there is a significant pressure of fuel sufficient to lift the valve member 13 from its seat 14. This pressure, referred to below as tank pressure, is significantly above atmospheric pressure. When fuel-supply demand has been met, pressure builds up on the left-hand face (as illustrated) of the diaphragm 16 and the resulting force is transmitted via the pivoted lever 15 to the inlet valve 12 which is then closed. In use, an equilibrium is established with the inlet valve partly open and allowing a fuel flow equal to engine demand.

From the inlet valve 12, the fuel, still in its liquid phase and at tank pressure, passes through an evaporation chamber 22 which is an internally ribbed heat exchanger which may be warmed by a flow of air or coolant liquid from the engine cooling system. In the evaporation chamber the liquefied gas boils and is converted completely into its vapour phase still at tank pressure and preferably at substantially ambient temperature.

From the evporation chamber 22, the gaseous fuel flows through a diaphragm-actuated pressure-reducing valve 24 which reduces the fuel pressure to just below atmospheric. Sub-atmospheric pressure in the gaseous fuel supply line 40 is desirable so that if the line 40 were fractured or detached there would not be a full bore gas leak into the engine compartment.

The pressure-reducing valve 24 comprises a valve disc 26 and valve seat 28 similar to those of the inlet valve, the valve disc 26 being mounted on a rocker arm 30 which receives a balance of opposing biases urging it in the open and closed directions. Biasing the rocker arm 30 to close the valve 24 is a spring 32 and the gas pressure in the fuel line 40, the gas pressure acting on a control diaphragm 34 spanning the vaporizer housing 36. Biasing the rocker arm to open the valve 24 is atmospheric pressure which enters the housing through apertures 38 and acts on the opposite face of the control diaphragm 34. The balance is such that fuel pressure in the fuel line 40 is slightly below atmospheric and is maintained constant. Any increase would cause the diaphragm 34 to close the valve 24, and any decrease would cause the diaphragm 34 to open the valve 24. The vaporizer 10 is entirely conventional.

The gas carburettor 50 is also entirely conventional. A diaphragm 52 is acted upon by atmospheric pressure on one side (the upper side as illustrated) and by the induction pressure of the engine (not shown) on the other side (the underside as illustrated). Charge air is fed to the carburettor (via the usual air filter) through an inlet duct 54. The charge air, at atmospheric pressure, acts on the outer periphery only of the diaphragm 52 and is insufficient in itself to overcome the bias of a spring 56. The spring 56 acts to seat an outer annular valve member 58 carried by the diaphragm 52 on a valve seat 60 to interrupt air flow, and to seat an inner disc-shaped valve member 62 carried by the diaphragm 52 on a valve seat 64 to interrupt fuel flow. Opening the engine throttle results in a reduction in the induction pressure of the engine, and that induction pressure is communicated through a fuel/air supply port 66 of the carburettor and through passages 68 to the underside of the diaphragm 52. That is sufficient to move the diaphragm 52 against the bias of the spring 56 and thus to lift the valve members 58 and 62 clear of their seats and permit fuel and charge air to mix and flow to the engine past a throttle valve 70 which is a conventional butterfly valve.

It will be understood that the above described conventional fuel supply offers not dynamic control at all of the pressure of the fuel/air supply or of the fuel/air ratio. Everything is factory set.

The arrangement in a pressure regulator for a compressed fuel stored in its gaseous phase, such as natural gas, methane or hydrogen, is similar except that a preliminary pressure reducing valve is used to cope with the much larger pressure reductions involved. The gas, reduced to a superatmospheric pressure substantially less than tank pressure, is passed from the preliminary pressure reducing valve to an inlet 11 of a pressure modulator that is substantially identical to the vaporizer 10 of FIG. 1. The gas pressure is reduced further at the inlet valve 12 of the pressure modulator and in a heat exchange chamber which corresponds to the evaporation chamber 22 of FIG. 1. It is heated to about ambient temperature to recover the heat lost during the pressure reduction due to the Joule effect. Typically, the pressure of the gaseous fuel, be it CNG, methane or hydrogen, is about 1 bar when it is supplied to the final stage pressure control valve which is identical to the pressure control valve 24 of FIG. 1.

Figure 2:
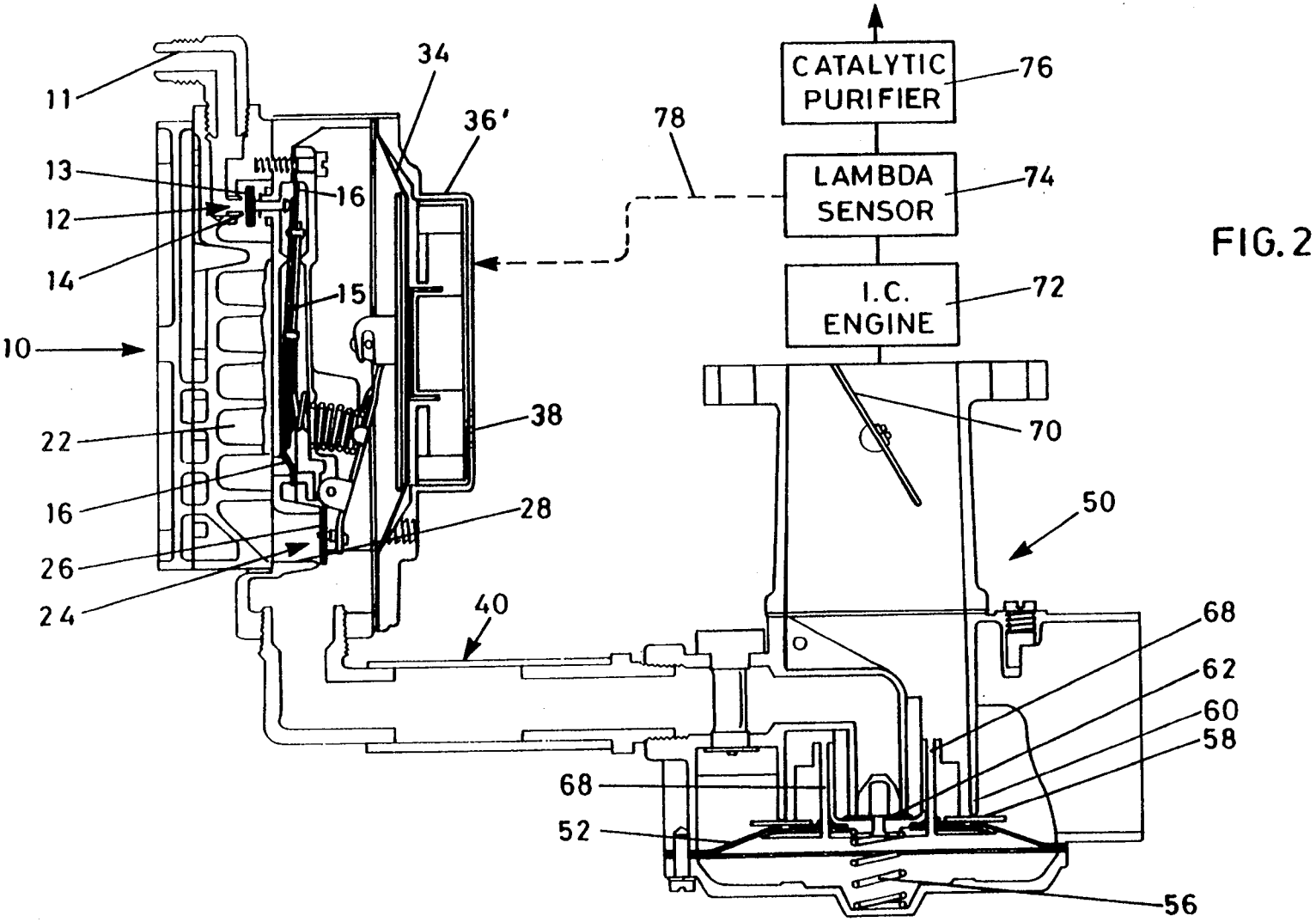
FIG. 2 is a similar section, with the associated elements of the engine indicated schematically, through the fuel supply of FIG. 1 modified to provide a fuel supply control according to the invention.

FIG. 2 shows how the fuel supply system of FIG. 1 can be modified according to the invention to provide a control over the oxygen content in the exhaust gases, sufficient to enable the engine to run efficiently using a catalytic exhaust gas purifier. In FIG. 2 the engine is shown schematically as 72, passing its exhaust gases via a catalytic purifier 76 to discharge to atmoshere. The electrical signal from the lambda sensor 74 is used as a feedback signal on an electrical line 78 to a control assembly 80 mounted on the diaphragm 34.

FIG. 2 shows a suitable adaptation of the vaporizer 10 of FIG. 1. The perforated outer housing cover 36 of the vaporizer of FIG. 1 is replaced by a larger cover 36′ of FIG. 2, which is situated over the control assembly 80 (FIG. 3).

The control assembly 80 comprises a coil 82 mounted on the diaphragm 34, and movable with the diaphragm relative to a central magnetic core 84. The housing of the control device 80 comprises an annular permanent magnet 86 secured to the magnetic core 84 which completes the magnetic flux path and ensures that any electrical current passed through the coil 82 imparts a bias to the diaphragm 34. The arrangement of coil 82, permanent magnet 86 and core 84 is very similar to that in a moving coil loudspeaker of audio equipment, and the signal on the electrical line 78 (FIG. 2) can be used to control two-way movement of the diaphragm 34.

It should be understood that the schematic representation of an electrical line 78 includes the possibility that the signal from the lambda sensor will be processed, for example in an engine management computer (not shown) before being applied to the coil 82. The arrangement ensures that an additional biasis exerted on the diaphragm 34 in response to the oxygen content in the exhaust gases, to influence the opening or closing of the pressure-reducing valve 24 of the vaporizer 10, so as to control the fuel/air ratio in the mixture supplied to the engine. This permits the engine to run with an exhaust gas catalytic purifier (76) whereas without such control of the fuel/air ratio the catalytic purifier would be ineffective or inefficient.

Figure 3:
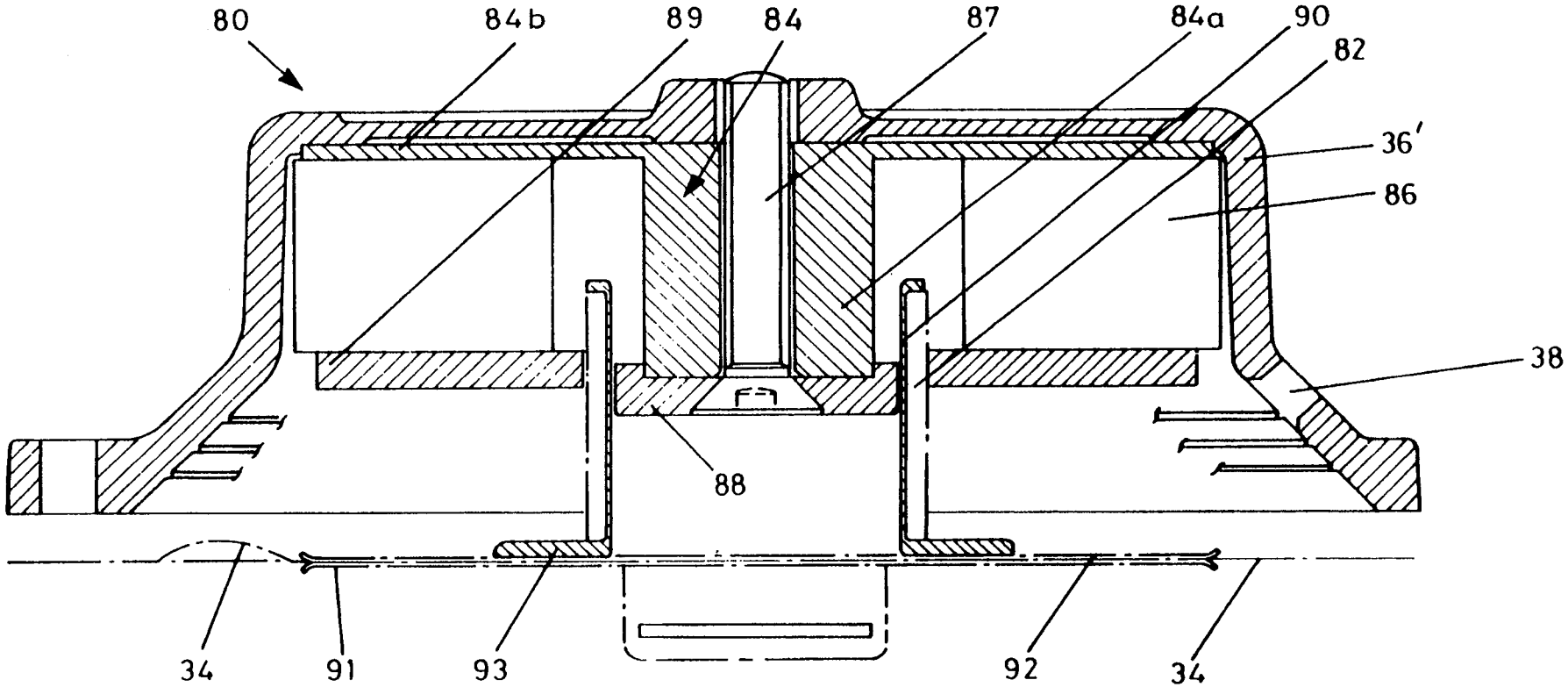
FIG. 3 is a section through the final, atmospheric pressure stage of the vaporizer of FIG. 2, to an enlarged scale.

FIG. 3 shows in greater detail one actual construction of the control assembly 80 of FIG. 2. The same reference numerals have been used for parts which are the same as, or perform the same function as, corresponding parts in FIGS. 1 or 2. Thus the cover 36′ is perforated at 38 to establish atmospheric pressure against the outer wall of the control diaphragm 34. The cover 36′ rigidly mounts a top-hat shaped central magnetic core 84 which is retained in position by a central countersunk screw 87 through a metal cap plate 88. The core 84 comprises a cylindrical central portion 84*a* and a radially extending disc portion 84*b* to which is glued a permanent ring magnet 86. To the base of the ring magnet 86 is glued a steel washer 89 which projects inwardly towards the base of the central portion 84*a* to complete the magnetic flux path apart from a narrow annular space between the washer 89 and the cap plate 88. Into this space extends the coil 82 which is wound on a lightweight coil former 90 of non-magnetic material.

The entire rigid structure of the core 84, magnet 86 and washer 89 is mounted concentrically on the housing 36 to a very high degree of accuracy, and similarly the coil 82 and coil former 90 are mounted accurately and centrally on the diaphragm 34. The mounting on the diaphragm 34 is as follows. The diaphragm 34 conventionally has two thin metal plates 91 and 92 one on either side of it and riveted together to provide reinforcement to the centre of the diaphragm. One of the plates 91 has a connection flange to couple the diaphragm 34 to the lever 30 (FIG. 1), transferring diaphragm bias to the final stage pressure-reducing valve (see FIG. 2). The coil former 90 preferably has an integral flange portion 93 which is glued to the plate 92. The connection may be reinforced by two electrically insulated screws (not shown) which pass via insulating washers (not shown) through the flange 93 of the former, the two plates 91 and 92 and the diaphragm 34 itself. These screws form a convenient pair of anchorages and terminals for connecting the rather fragile wire ends of the coil 82, and to the same screws can be connected braided flexible connections (not shown) to the control circuitry, to accommodate movement of the diaphragm in use.

One feature of the design is that the annular space between the steel washer 89 and the cap plate 88 is kept to an absolute minimum without fouling the coil 82, thus achieving maximum flux density. This results in the maximum correcting force for a given current to the coil. The current generates heat, and to ensure reliability of the coil winding insulation it is good practice to keep this current to a minimum. It will be appreciated that when the system is operating in an accurately closed loop, then the corrections required are small and therefore the current and heating effect are small.

The above embodiment can be modified by substituting a known venturi device for the gas carburettor 50. Operation of the control assembly 80 is not affected.

Figure 4:
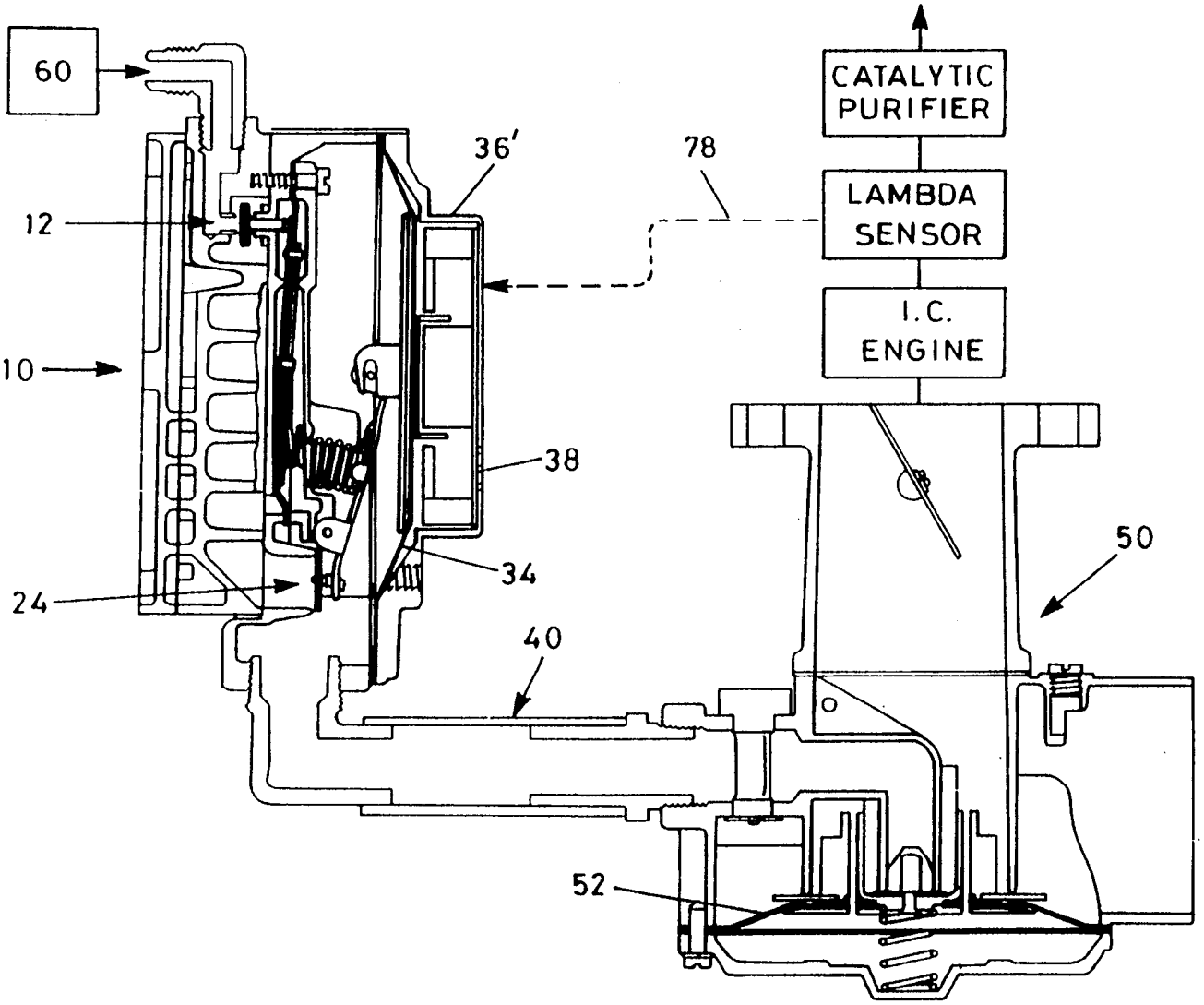
FIG. 4 is a section similar to that of FIG. 2 but illustrating a fuel supply according to the invention of a CNG or compressed methane or compressed hydrogen fuelled engine.

Alternatively the above illustrated embodiment can be modified by fitting the electrical coil and fixed permanent ring magnet not to the control diaphragm 34 of the vaporizer 10 of FIG. 2 but to a control diaphragm of a pressure regulator 10' of a control system of a compressed gas fuelled engine, as illustrated in FIG. 4. In FIG. 4 the same reference numerals have been used as in the preceding Figures for parts with the same construction or function. The principal difference between FIGS. 4 and 2 is that, because FIG. 4 is a control for compressed gas fuelled engines rather than for liquefied gas fuelled engines, the initial gas supply is at a much higher pressure which must be stepped down in a preliminary pressure reducing valve 60. The valve 12 then becomes the second pressure-reducing valve, and the diaphragm-actuated valve 24 becomes the final stage valve in the pressure regulator 10'. No liquid evaporates in the chamber 22, but the heat exchange construction of the chamber 22 is still utilized in exactly the same way as in FIG. 2 to counter the refrigerating effect of the expansion of the supplied gaseous fuel.

Alternatively the embodiment of FIGS. 2 or 3 can be modified by fitting the electrical coil and fixed permanent ring magnet not to the diaphragm 34 but to the control diaphragm 52 of the gas carburettor 50 of FIGS. 2 or 3. No further illustration is necessary to demonstrate how a signal from the lambda sensor indicating too much oxygen in the exhaust gases will result in partial or temporary closure of the concentric air and fuel valve ports between the valve members 58 and 62 and their valve seats 60 and 64; and how a signal indicating too little oxygen will result in an opening of those valve ports.

The fuel supply control of the invention preferably further comprises an engine speed sensor (not shown), a pressure transducer (not shown) connected to an inlet manifold of the engine and responsive to the inlet manifold pressure downstream of the gas carburettor or venturi, and a memory facility receiving and storing signals from the engine speed sensor, the pressure transducer and the lambda sensor. The memory facility preferably builds up and maintains a dynamic map representing the correlation between engine speed and inlet manifold pressure on the one hand, and the feedback signal to the coil on the other hand, so that in situations of transient changes in the engine conditions, the dynamic map in the memory can be used as a look-up table to determine the ultimate lambda sensor output and required feedback signal far more rapidly than the several hundred milliseconds needed for the diaphragm actuated valve to modify the fuel flow, for the modified fuel flow to be mixed with the charge air and burned in the engine, for the resulting exhaust gases to pass down the exhaust pipe to the lambda sensor and for the lambda sensor to react to the oxygen content therein. Also the use of such a dynamic map as a look up table gives rise to greatly increased stability in idling conditions. A computer incorporating the memory facility can vary both the time between corrections, typically from 10 to 20 milliseconds, and the amount of the correction. A small correction and a short time interval gives very rapid response suitable for high fuel flows and transient conditions. A larger correction and longer time intervals gives a slower response suitable for idle conditions. The computer is able to sense, from the speed and manifold pressure inputs, the engine condition and to select from the dynamic map the optimum feedback signal for that engine condition and the optimum frequency of updating that feedback signal. Preferably the dynamic map is extended or modified whenever the engine condition and lambda sensor output have stabilized over a predefined time, for example one second. In this way, the computer can be regarded as self learning.

A further advantage of using a 'self-learning' computer is during start-up. The lambda sensor only sends a voltage signal when it is hot. When starting from cold, it can take 20 seconds or more for the exhaust gas to heat up the lambda sensor to a point where it starts to function properly. During this time, in the absence of a memory look-up table the fuel system would operate open loop not under the control of the electronics. A dummy signal derived from the look up table and determined from the last time the engine was running and the lambda sensor was functional is much preferred to no signal at all. Heated lambda sensors which have electrical heating elements in them to start warming up as soon as the engine is switched on help considerably but there is still a significant delay in signal stabilization. Those skilled in the art of fuel control systems and exhaust emission analysis advise that the worst exhaust emissions by far occur during the first 30 seconds of engine start up from cold. It is thus of very great importance that the invention makes it possible to achieve low exhaust emissions during the 'start up from cold' period so that the exhaust catalyst can function properly and reduce exhaust emissions to the minimum possible.

We claim:

1. A fuel supply control for a gaseous fuelled internal combustion engine in which the flow of gaseous fuel is controlled by a diaphragm-actuated valve responsive to atmospheric pressure, characterised in that the diaphragm of the diaphragm-actuated valve carries a moving coil element secured thereto and concentric with a fixed permanent ring magnet, and a lambda sensor in the exhaust gas stream from the engine supplies an electrical feedback signal to the coil to impart a variable bias on the diaphragm in accordance with the oxygen content of the exhaust gas stream as sensed by the lambda sensor, to control the fuel or fuel-and-air supply to the engine in accordance with desired engine operating parameters.

2. A control according to claim 1, wherein the gaseous fuel is stored in the liquid phase and the diaphragm-actuated valve is a final valve element of a vaporizer for the fuel.

3. A control according to claim 2, wherein the vaporizer has two control valve elements, one for metering liquefied fuel into a heat exchange chamber for evaporation thereof and the other for controlling the delivery pressure of the gaseous fuel to the engine.

4. A control according to claim 3, wherein the heat exchange chamber is in heat exchange relationship with fluid from the engine cooling system.

5. A control according to claim 1, wherein the gaseous fuel is stored in the gaseous phase as compressed gas, and the diaphragm-actuated valve is a final valve element of a multi-stage pressure regulator for the fuel.

6. A control according to claim 5, wherein the pressure regulator is a three-stage pressure regulator.

7. A control according to claim 6, wherein between second and third stages the pressure regulator comprises a heat exchange chamber for raising the temperature of the pressure-regulated gaseous fuel following a Joule effect temperature reduction during expansion of the gaseous fuel in the first and second stages.

8. A control according to claim 7, wherein the heat exchange chamber is in heat exchange relationship with fluid from the engine cooling system.

9. A control according to claim 1, wherein the diaphragm-actuated valve is a valve member of a gas carburettor.

10. A control according to claim 1, wherein the electrical feedback signal from the lambda sensor is processed in an engine management computer before being supplied to the coil to impart the variable bias on the diaphragm.

11. A control according to claim 10, wherein the computer processing of the electrical feedback signal comprises detecting a transient condition of the engine and substituting for the feedback signal, during that transient condition, an appropriate feedback signal derived from a look-up table in the computer memory.

12. A control according to claim 11, further comprising means for detecting a stable condition of the engine and updating or extending the look-up table parameters in the computer memory with the feedback signal appropriate to that stable condition.

13. A control according to claim 11, wherein the transient condition of the engine is the condition during engine warm-up.

* * * * *

UNITED STATES PATENT AND TRADEMARK OFFICE

CERTIFICATE OF CORRECTION

PATENT NO. : 5,357,938

DATED : October 25, 1994

INVENTOR(S) : Timothy J. Bedford and John W. Kirkland

It is certified that error appears in the above-identified patent and that said Letters Patent is hereby corrected as shown below:

Column 3, line 29, "<" should be -- > --.

Column 5, line 38, "not" should be -- no --.

Column 5, line 67, -- lambda -- should be inserted after "a".

Column 6, line 25, "biasis" should be -- bias is --.

Column 6, line 67, "92" should be -- 91 --.

Signed and Sealed this

Eleventh Day of July, 1995

*Attest:*

*Attesting Officer*

Bruce Lehman

BRUCE LEHMAN

*Commissioner of Patents and Trademarks*